US005128208A

United States Patent [19]

Bond et al.

[11] Patent Number: 5,128,208

[45] Date of Patent: Jul. 7, 1992

[54] FLAGGABLE SYNTHETIC TAPERED PAINTBRUSH BRISTLES

[75] Inventors: William B. Bond, Marietta, Ohio; Robert L. Rackley, Parkersburg, W. Va.

[73] Assignee: E. I. Du Pont de Nemours and Company, Wilmington, Del.

[21] Appl. No.: 629,660

[22] Filed: Dec. 14, 1990

[51] Int. Cl.[5] ..... D01F 6/00; D02G 3/00

[52] U.S. Cl. ..... 428/397; 428/398; 428/401; 15/207.2

[58] Field of Search ..... 428/359, 364, 397, 398, 428/401, 395; 15/159 A, 159 R; 425/131.5, 461, DIG. 217

[56] References Cited

U.S. PATENT DOCUMENTS

| | | | |
|---|---|---|---|
| 3,493,459 | 2/1970 | McIntosh et al. | 428/398 |
| 3,745,061 | 7/1973 | Champaneria et al. | 428/398 |
| 4,020,229 | 4/1977 | Cox, Jr. | 428/372 |
| 4,279,053 | 7/1981 | Payne et al. | 15/159 A |
| 4,770,938 | 9/1988 | Peterson et al. | 428/398 |
| 4,937,141 | 6/1990 | Burns | 428/376 |

*Primary Examiner*—George F. Lesmes
*Assistant Examiner*—Christopher Brown

[57] ABSTRACT

A synthetic polymeric paint brush bristle having the appearance and performance of natural hog bristle, having been formed from at least three strands of polymer.

8 Claims, 2 Drawing Sheets

FLAGGABLE SYNTHETIC TAPERED PAINTBRUSH BRISTLES

BACKGROUND OF THE INVENTION

Thermoplastic polymers have long been used in the preparation of brush bristles. Such bristles have been prepared in a wide variety of configurations, including both solid and hollow monofilaments, and are generally tapered from the butt end to the tip end of the bristle. These polymeric bristles have provided advantages over natural bristles such as hog hair in both cost and performance for the brushmaker and durability for the consumer.

The performance advantages of polymeric materials in water based paints have long been recognized because natural hog bristle becomes very limp as it absorbs water. However, for premium quality brushes, boar bristle brushes have been preferred by the professional painter in oil based paint varnishes and shellac. The advantage of hog bristle in these applications is felt to be the random discrete flags at the tip end of the bristle. These flags increase the ability of a brush to hold and release paint and provide a smooth surface. Tipping is another commercial bristle finishing operation in which individual bristles are ground down to a fine point. Tipping and flagging are used together, individually and alternately. The art of finishing synthetic tapered bristles varies among manufacturers. However, all are aimed at duplicating the painting performance of hog bristle brushes.

A variety of hollow synthetic bristles have been previously developed, such as those described in Payne et al., U.S. Pat. No. 4,279,053. However, hollow brush bristles flag very easily, so that the flagging operation is usually minimized or eliminated by the brush manufacturer. Moreover, hollow bristles have not been favored in the professional paintbrush segment because of durability and cleanability.

SUMMARY OF THE INVENTION

The present invention provides a tapered, substantially round bristle formed by the joining of three or more individual streams of polymeric material from a spinneret. The bristle exhibits excellent flaggability, durability and cleanability, combined with painting performance, in a finished brush, equal or superior to that of hog bristles.

Specifically, the instant invention provides, in a tapered monofilamentary paintbrush bristle of thermoplastic polymeric material having a diameter of about from 4 to 20 mils, the improvement wherein the bristle has at least three internal fusion lines and longitudinal apertures along each of the internal fusion lines, and in which the width of each longitudinal aperture is no greater than D/25, where D is the diameter of the bristle at any point along its tapered length.

DETAILED DESCRIPTION OF THE INVENTION

Figure 1:
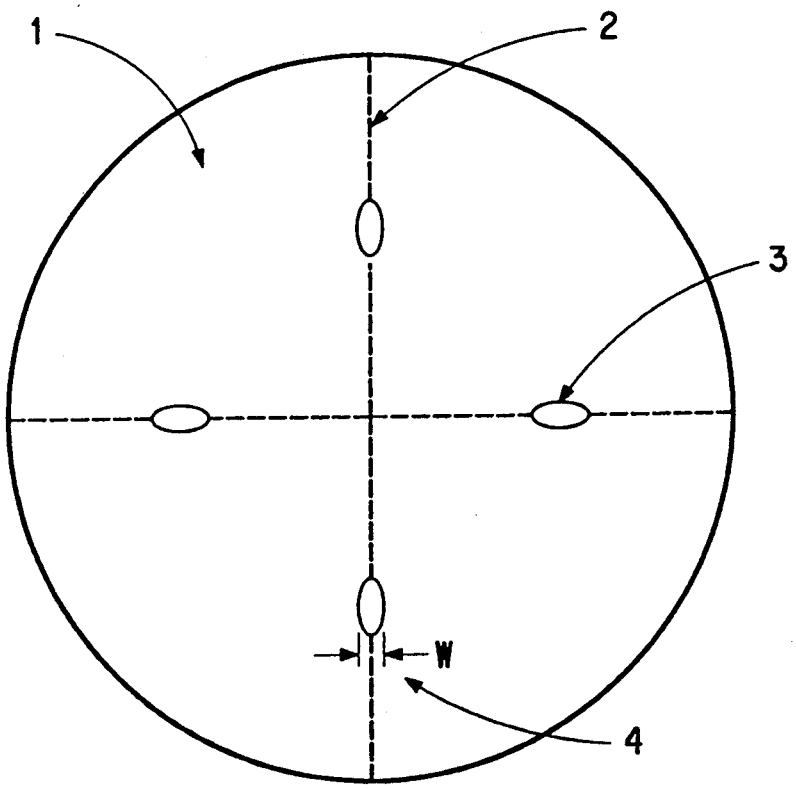
FIG. 1 is a cross-sectional illustration of a polymeric brush bristle of the present invention.

The brush bristles of the present invention can be prepared from a wide variety of thermoplastic polymeric materials including polyamides, polyesters and polyolefins. In general, the number average molecular weight of the polymer used for the brush bristles should be in the excess of 10,000, to provide the strength and stiffness needed in a brush bristle. Polyamides preferred for use in brush manufacturing include nylon 6,6, nylon 610, and nylon 612. Of these, nylon 610 (polyhexamethylene sebaccamide) and nylon 612 (hexamethylene diamine) are particularly preferred. Polyesters which have been found particularly well suited to bristle manufacture include polybutylene terephthalate and polyethylene terephthalate, of which polybutylene terephthalate is particularly preferred. Of the many polyolefins which can be used for bristle manufacture, polypropylene is preferred.

The overall diameter, or maximum cross-sectional dimension, of the polymeric brush bristles of the present invention can be about from 4 to 20 mils. Filaments outside of this range, in general, will exhibit stiffness which is unsuitable for brush bristle applications. The bristles are generally about from 2 to 5 inches long.

The bristles of the present invention are formed by the extruding three or more individual streams of polymeric material from a spinneret, and joining the streams to form a single filament. The fusion of the three streams results in fusion lines at the interface of the individual streams, and the formation of longitudinal voids along the fusion lines. The general configuration of the voids can vary widely, but the maximum dimension of each void should not exceed D/25, wherein D is the diameter of the filament at the point of the void.

After extrusion of thermoplastic polymer at elevated temperatures from the three or more streams into a filament, the filament is quenched and then drawn as generally described, for example, in U.S. Pat. No. 2,418,492, hereby incorporated by reference.

The filaments of the present invention can be more fully understood by reference to the drawings, in which FIG. 1 is a cross-sectional view of a filament 1 of the invention, prepared by the fusion of four polymer streams. The weld or fusion lines 2 include voids 3, which have a width 4 which is no greater than D/25, wherein D is the diameter of the bristle at the cross-section of the voids. The voids result in a void content of less than about 5% of the cross-sectional area of the monofilaments, and preferably less than about 1%.

Figure 2:
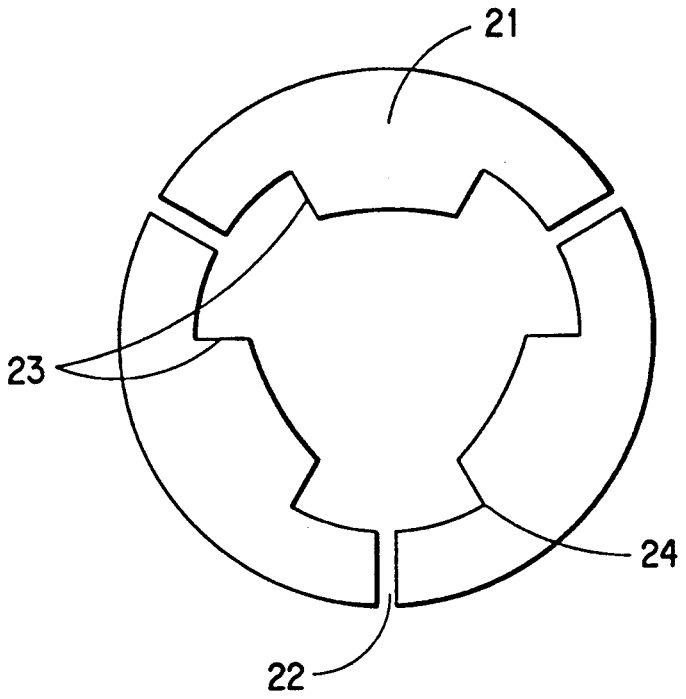
FIGS. 2 and 3 are planar illustrations of spinneret orifices which can be used to prepare the brush bristles of the present invention.
Figure 3:
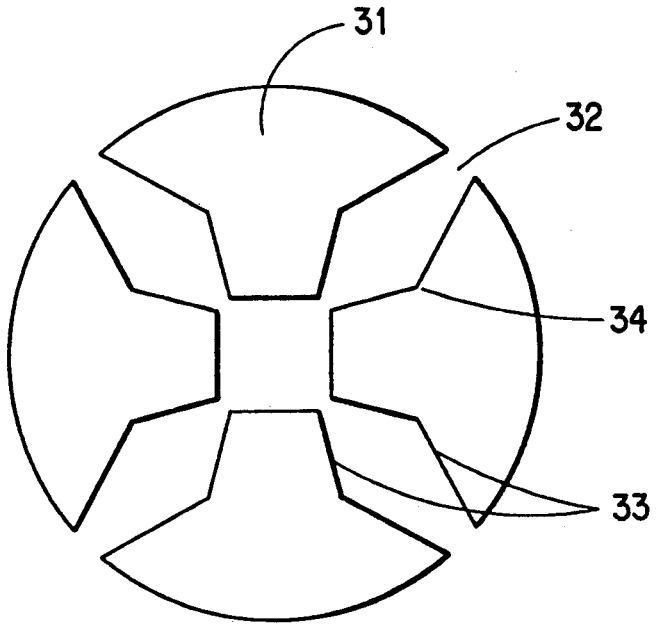

The streams from which the present filaments are formed can be extruded through spinnerettes of the type shown in plan view in FIGS. 2 and 3, which can be used to prepared filaments from three and four polymer streams, respectively. In the extrusion of thermoplastic polymer streams, the polymer is extruded through openings 21 and 31, in FIGS. 2 and 3, the spinneret being retained in the apparatus by support points 22 and 32. The weld lines are formed in the extruded and fused streams as the surface 23 and 33 of the individual streams join together after exiting the orifice. The indentations 24 and 34 in the openings result in the weld line openings in the finished filaments.

After extrusion and quenching of the polymeric monofilament, the filament is oriented by stretching to improve the longitudinal strength, generally about from 3.5 to 5 times the original length. Before quenching and orientation, the filament can, if desired, be tapered as described in the aforementioned U.S. Pat. No. 2,418,492. In general, such filaments are tapered to provide a tip diameter which is about from 0.5 to 0.75 times the diameter of the butt end. In addition, the filament can be subjected to other treatments to improve physical properties, such as treatment with saturated steam as described in U.S. Pat. No. 3,595,952, hereby incorporated by reference.

The filament is preferably heat set after drawing for good bend recovery. The heat setting can be carried out either in a gas such as by blowing hot air over the filament, or in a liquid bath such as by passing the filament through a bath of oil. The filament should remain in the heat setting stage for about from 30 to 90 seconds in a gas, or about from 2 to 10 seconds in a liquid bath. Temperatures which can be used for the heat setting operation are 150 to 200° C. when using a gas, and 140° to 200° C. when using a liquid bath.

The filaments are then cut into lengths suitable for brush manufacture. Tapered filaments are cut at their thick and thin portions to form individual tapered bristles.

The individual bristles are then gathered into bundles and the tip ends of the bristles tipped and flagged by conventional procedures as described, for example, in U.S. Pat. Nos. 2,697,009 and 2,911,761. The bristles can then be fabricated into brushes using techniques well known in the art.

The brush bristles of the present invention, on contact with typical flagging apparatus, produce a larger number of flags than monolocular monofilamentary bristles or solid monofilaments of the same diameter. In addition, the bristles of the present invention exhibit less tendency to curl and markedly greater resistance to crushing than hollow monofilaments. The bristles exhibit excellent durability and cleanability, combined with painting performance, in a finished brush, equal or superior to that of hog bristles.

The present invention is further illustrated in the following specific Example and Comparative Examples.

EXAMPLE I AND COMPARATIVE EXAMPLES A AND B

In Example 1, nylon 612 was extruded through a spinneret plate as shown in FIG. 2. The polymer was extruded at a temperature of 270° C. and quenched in 25° C. water located about one inch below the spinneret plate. The resulting filaments were tapered using rubber pinch rolls which were operated at a cyclically varying surface speed as described in U.S. Pat. No. 2,418,492, which resulted in a correspondingly varying strand caliper from 16 to 24 mils.

The tapered filaments were oriented by drawing to 3.75 to 4.25 times their original length with a conventional slow roll/fast roll arrangement and were heated by conventional heaters during the draw stage. The filaments were heat set by passing through a hot air oven and maintained at 170° to 180° C. for approximately 40 seconds.

After spinning, drawing and heat setting, the filaments were cut at each point of minimum diameter and gathered as bundles of product. Rubber bands were placed on the bundles and each two-inch diameter bundle was again center cut and ends trimmed to produce two bundles four inches long, suitable for further processing into paintbrushes.

The monofilaments were cross-sectioned and under high magnification the width of the opening in the weld line as illustrated in FIG. 1 was D/300.

The two-inch diameter bundles were processed on a commercial tipping and flagging machine typical of those used in industry, by passing over grindstones and through rotating knives. The bundles were passed through the machine for four passes with ¼ inch interference between the small diameter 0.008 inch end of the bristle and the grindstones and knives.

The bristles were compared for softness with standards for bristle practice and were found to be exceptionally soft, further confirming a large number of small flags generated.

In Comparative Example A, the general procedure of Example 1 was repeated, except a round hole was used in the spinneret which produces no weld lines. The filament used in Comparative Example B was natural hog bristle.

The filaments of Example 1 and Comparative Examples A and B were used in the preparation of three brushes prepared according to commercial manufacturing techniques used with natural hog bristles. The resulting brushes are evaluated on the basis of weight of paint picked up, paint delivered, and length of paint stripe when evaluated in a mechanical paint out tester. The mechanical paintbrush tester simulates a painter painting a horizontal stripe on a vertical wall. The procedure is as follows:

Equipment

Paintbrush

Standard Paint; Sears oil-based Weatherbeater 30 25025 White Color 002.

Kraft paper; 30-lb. Kraft roll cut 6" wide, maximum diameter 9½", 3" Core I.D., available from M. Conley, 13212 Fourth Street SE, Canton, Ohio 44701.

Leneta paper, all black, lacquered on one side, cut to 17×6½" wide.

Paintest Tester

Electronic Balance good to 0.01 grams.

Procedure

1. Remove brush handle, and weigh brush.
2. Measure length of filament clear of ferrule.
3. Set speed dial at 70%. Use magnetic clamps to hold fresh Kraft paper in place.
4. Install brush in clamp so ferrule is flush with clamp edge.
5. Set brush clamp so the bristle tips just touch the steel panel back of the Kraft paper. Read the scale setting. Subtract the desired brush displacement from the scale setting and move the brush in the clamp until the new setting is reached. The center of the ferrule should then be displaced the desired distance from the steel panel.

| Filament Length Clear inches | Brush Displacement inches | Dip Distance inches |
|---|---|---|
| 1¾ | ⅝ | ⅞ |
| 2 | ¾ | 1 |
| 2¼ | ⅞ | 1⅛ |
| 2½ | 15/16 | 1¼ |
| 2¾ | 1 | 1⅜ |
| 3 | 1⅛ | 1½ |
| 3 | 1⅛ | 1½ |
| 3¼ | 1 3/16 | 1⅝ |
| 3½ | 1 5/16 | 1¾ |

-continued

| Filament Length Clear inches | Brush Displacement inches | Dip Distance inches |
|---|---|---|
| 3 | 1¼ | 1½ |
| 3¼ | 1 3/16 | 1⅝ |
| 3 1/7 | 1 5/16 | 1¾ |
| 3¾ | 1⅞ | 1⅞ |
| 4 | 1½ | 2 |
| 4¼ | 1 9/16 | 2⅛ |
| 2½ | 1 11/16 | 2¼ |

6. Remove clamp with brush, and install in dip clamp.
7. Set stop on dip rod so that brush dips in paint ½ the distance clear.
8. Dip brush for 30 seconds and let drip for 30 seconds by raising dip rod.
9. Replace in tester, and pass, back and forth, over Kraft paper, twice.
10. Wind in new Kraft paper, and repeat.
11. Wind in fresh sheet of Kraft paper, and install black Leneta chart paper so that brush will paint a stripe in the center.
12. Dip brush once more 30 seconds and let drip 30 seconds, weigh brush and clamp and then paint one strip forward and reweigh brush and clamp without letting it return.
13. Remove the brush and weigh empty clamp before installing the next brush. Use this as tare weight for measurements made in 12.
14. Once paint is dry measure length of stripe to where black begins to show.
15. Remove and clean brush in varsol or turpentine.

The performance of the brush is judged by the amount of paint picked up, the amount delivered by value and percentage and the length of the paint stripe. The results from this test procedure will vary depending on many variables including the length of filament used, the diameters of the filaments, the method of tipping and flagging, the type of paint and degree of filling. However, the data below indicate that the bristles of the present invention represent a marked improvement over solid round filaments and natural bristle in an oil-based paint.

| | Example | | |
|---|---|---|---|
| | 1 | A Solid | B China Bristle |
| Weight of Paint Picked up | 37 gr. | 28 g | 48 g |
| Weight Delivered | 3.8 gr. | 1.7 gr. | 3.8 gr. |
| % Delivered $\left(\frac{B}{A} \times 100\right)$ | 10.3 | 6.1 | 7.5 |
| Paint Stripe Length (cm) | 35.6 | 22.9 | 25.4 |

We claim:

1. In a tapered monofilamentary paintbrush bristle of thermoplastic polymeric material having a diameter of about from 4 to 20 mils, the improvement wherein the bristle has a least three internal fusion lines and longitudinal apertures along each of the internal fusion lines, and in which the width of each longitudinal aperture is no greater than D/25, where D is the diameter of the bristle at any point along its tapered length, and wherein the longitudinal apertures comprise less than about 1% of the cross-sectional area of the bristle.

2. A paintbrush bristle of claim 1 wherein the polymeric material consists essentially of polyamide.

3. A paintbrush bristle of claim 2 wherein the polyamide consists essentially of nylon 612.

4. A paintbrush bristle of claim 2 wherein the polyamide consists essentially of nylon 610.

5. A paintbrush bristle of claim 1 wherein the polymeric material consists essentially of polybutylene terephthalate.

6. A paintbrush bristle of claim 1 which is tipped and flagged.

7. A bristle of claim 1 having three internal fusion lines.

8. A bristle of claim 1 having four internal fusion lines.

* * * * *